US007255216B2

(12) United States Patent
Izawa et al.

(10) Patent No.: US 7,255,216 B2
(45) Date of Patent: Aug. 14, 2007

(54) BILL HANDLING MACHINE

(75) Inventors: Hikaru Izawa, Osaka (JP); Nobuo Shoji, Osaka (JP)

(73) Assignee: Japan Cash Machine Co., Ltd. (JP)

( * ) Notice: Subject to any disclaimer, the term of this patent is extended or adjusted under 35 U.S.C. 154(b) by 0 days.

(21) Appl. No.: 10/515,855

(22) PCT Filed: May 27, 2003

(86) PCT No.: PCT/JP03/06576

§ 371 (c)(1),
(2), (4) Date: Dec. 27, 2004

(87) PCT Pub. No.: WO03/100735

PCT Pub. Date: Dec. 4, 2003

(65) Prior Publication Data

US 2006/0163030 A1 Jul. 27, 2006

(30) Foreign Application Priority Data

May 27, 2002 (JP) ..... 2002-152208

(51) Int. Cl.
*G07F 9/10* (2006.01)

(52) U.S. Cl. ..... 194/350

(58) Field of Classification Search ..... 194/350, 194/207, 302, 344; 902/8, 9, 11, 12, 13, 902/15, 16; 271/163, 164, 145; 399/371
See application file for complete search history.

(56) References Cited

U.S. PATENT DOCUMENTS 4,874,931 A * 10/1989 Oka et al. ..... 235/379
5,653,436 A * 8/1997 Zouzoulas ..... 271/177
5,662,202 A * 9/1997 Suris ..... 194/206
6,371,473 B1 * 4/2002 Saltsov et al. ..... 271/3.01
6,773,009 B2 * 8/2004 So ..... 271/259

FOREIGN PATENT DOCUMENTS

EP 0 675 465 A1 10/1995

* cited by examiner

*Primary Examiner*—Patrick Mackey
*Assistant Examiner*—Mark J. Beauchaine
(74) *Attorney, Agent, or Firm*—Gerald E. Hespos; Anthony J. Casella

(57) ABSTRACT

A bill handling machine includes a machine body 10 for conveying bills 3 and storing bills other than a bill 3 to be discharged and a detachable box 20 having a mounted section 21 detachably mounted to a mount section 11 of the machine body 10 for storing and discharging the bill 3 to be discharged. The machine body 10 includes distinguishing device (14*b* and 14*c*) for distinguishing whether or not the bill 3 is a dischargeable bill, conveying device 12 for conveying the bills 3 in the normal or reverse direction between the distinguishing device and the mounting section 11, and a keeping bill storage section 15 for storing the bills 3 other than the bill 3 to be discharged which is conveyed by the conveying device 12. The detachable box 20 includes a dischargeable bill storage section 25 for storing the bill 3 so as to be discharged.

3 Claims, 11 Drawing Sheets

BILL HANDLING MACHINE

FIELD OF THE INVENTION

The present invention relates to a bill handling machine installed in the interior of an automatic vending machine, money exchanger, game machine, etc. which receives several kinds of bills from the exterior to store them temporarily and discharges a specified bill from the stored bills to the exterior.

DESCRIPTION OF THE RELATED ART

As an example of the conventional bill handling machine is known a bill handling machine shown in FIG. 9 (see Japanese Examined Patent Publication No. HEI2-26274). The bill handling machine is adapted to store several kinds of bills which are received as genuine money from a slot 100 and give back a specified bill from the stored bills as change, and includes a keeping bill storage section 101 for storing bills other than bills to be discharged and two dischargeable bill storage sections 102 and 103 for storing bills to be discharged in such a way to discharge them. The machine is constructed to give back change bills while being capable of receiving several kinds of bills using these storage sections 101 to 103. The two dischargeable bill storage sections 102 and 103 are operable to drive belts 102*a* and 103*a* in one direction to receive a bill, and to drive them in the other direction to give back a bill.

In this conventional bill handling machine, when the dischargeable bill storage sections 102 and 103 become full of bills, these bills are conveyed to the keeping bill storage section 101 in a standby state of waiting bill insertion in order to allow next bill storing operation. However, it takes a lot of time to convey bills to the keeping bill storage section 101 after the fulfillment. Moreover, if a bent bill or a curled bill which is likely to cause jamming is stored, such bill highly causes jamming in the course of being conveyed, which results in the disadvantages of taking much time to recover it and suspend the bill handling during the recovery operation.

SUMMARY OF THE INVENTION

It is an object of the invention to provide a bill handling machine which is free from the problems residing in the conventional art.

It is another object of the invention to provide a bill handling machine which can prevent the occurrence of bill jamming in the bill handling machine, and eliminate the necessity of recovery due to the occurrence of the bill jamming, and consequently assure quick bill handling operation.

According to an aspect of the present invention, a bill handling machine receives multiple kinds of bills from the exterior to store them temporarily and discharge a specified bill from the stored bills to the exterior. The bill handling machine includes a machine body and a detachable box for storing and discharging a dischargeable bill. The machine body includes a distinguishing device for distinguishing whether or not a bill received from the exterior is a dischargeable bill, and a keeping bill storage section for storing bills other than the dischargeable bill. The detachable box includes a dischargeable bill storage section for storing at least the dischargeable bill.

These and other objects, features, aspects, and advantages of the present invention will become more apparent from the following detailed description of the preferred embodiments/examples with reference to the accompanying drawings.

DETAILED DESCRIPTION OF THE PREFERRED EMBODIMENT OF THE INVENTION

A bill handling machine according to an embodiment of the present invention will be specifically described hereinafter.

Figure 1:
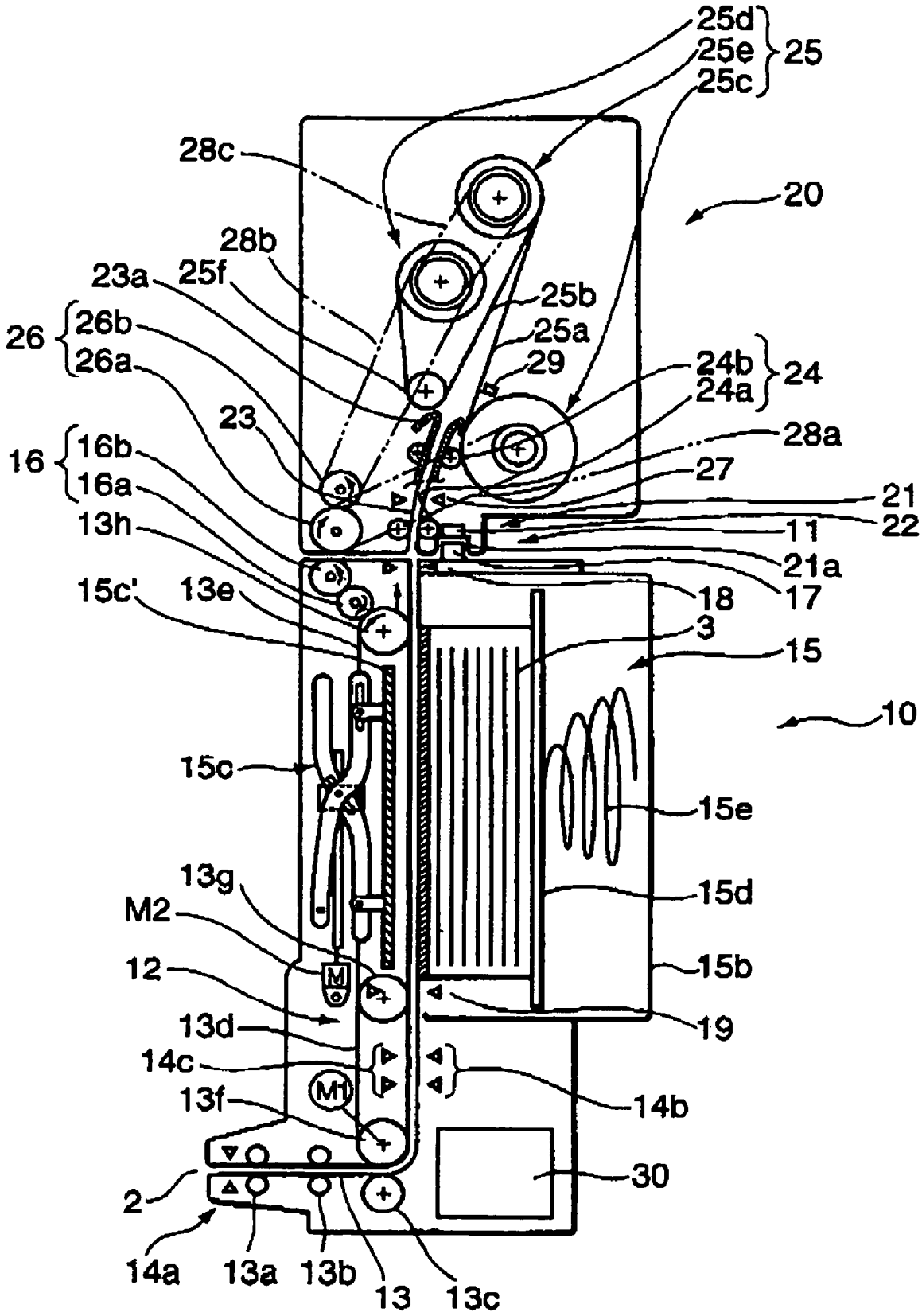
FIG. 1 is a side sectional view of a bill handling machine according to an embodiment of the present invention, showing a state in which a detachable box is mounted to a machine body.
Figure 2:
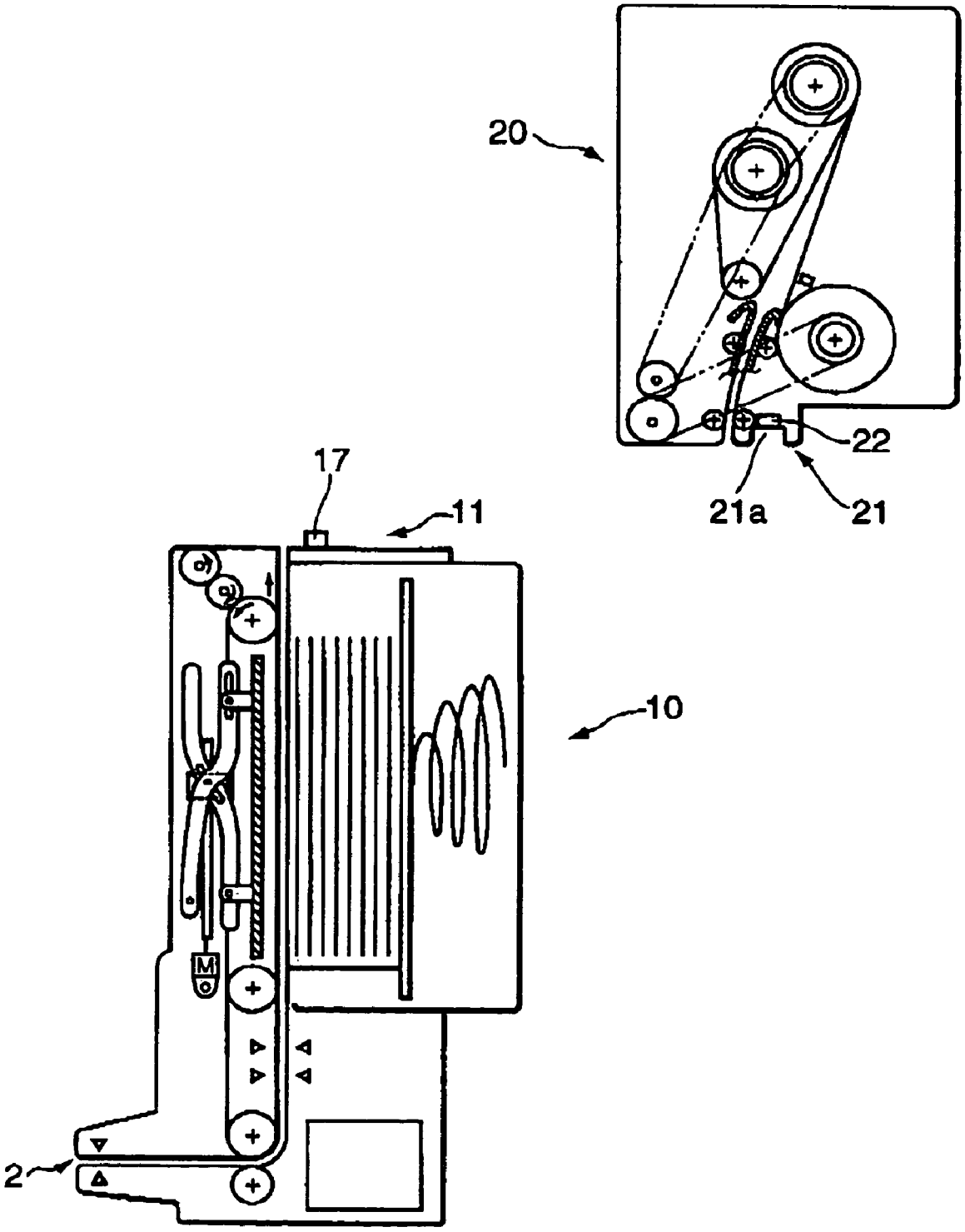
FIG. 2 is a side sectional view of the bill handling machine, showing a state in which the detachable box is detached from the machine body.

FIGS. 1 and 2 are side sectional views showing a bill handling machine according to the embodiment, wherein FIG. 1 shows a state in which a detachable box is mounted to a machine body and FIG. 2 shows a state in which the detachable box is detached from the machine body.

The bill handling machine 1 is constructed to receive several kinds of bills 3 from the exterior and stores them temporarily and, when giving back change, to give back a specified bill 3 from the stored bills 3 to the exterior. Specifically, the bill handling machine 1 includes a machine body 10 disposed at the lower part for conveying a bill 3 received via a slot 2 from the exterior and storing the bill 3 other than a bill to be given back, and a detachable box 20 having a mounted section 21 detachably mounted to a mounting section 11 provided at the upper part of the machine body 10 for storing bills 3 for change conveyed from the machine body 10 and discharging it to the slot 2. Although only one detachable box 20 is shown, a plurality of, for example, two boxes are provided, one of which is selectively used.

The machine body 10 includes a first conveying device 12 for conveying the bill received through the slot 2. The first conveying device 12 includes a convey passage 13 between the slot 2 and the mounting section 11, through which it conveys the bill 3 along the length of the bill 3. The first conveying device 12 further includes two pairs of opposing rollers 13*a* and 13*b*, a conveying belt 13*d*, a roller 13*c* opposed to the conveying belt 13*d*, and a conveying belt 13*e* along the convey passage 13 in this order from the side of the slot 2. The conveying belt 13*d* is driven by the operation of a drive pulley 13*f* adjacent to the slot 2 by a conveying motor M1, while the conveying belt 13*e* adjacent to the mounting section 11 is driven by receiving the driving force of the conveying belt 13*d* through a common pulley 13*g*. The driving and suspension of the first conveying device 12 with such a structure are controlled by a controller device 30 provided in the machine body 10. Bills are conveyed in a normal direction from the slot 2 toward the mounting section 11 and in a reverse direction from the mounting section 11 toward the slot 2.

An inlet sensor 14*a* of, for example, a penetration type is disposed in the vicinity of the slot 2 for detecting whether or not a bill is inserted. Distinguishing sensors 14*b* and 14*c* of, for example, a reflection type are arranged in the position of the conveying belt 13*d* to sandwich the convey passage 13 as a distinguishing device. The distinguishing sensors 14*b* and 14*c* distinguish whether the conveyed bill is genuine or not, and also optically determine whether the bill is a dischargeable bill or not. A first passage sensor 19 of, for example, a penetration type is disposed in the vicinity of the conveying belt 13*d* for detecting the passage of a bill through the convey passage 13. Signals detected by the sensors 14*a*, 14*b*, 14*c*, and 19 are outputted to the controller device 30. Although the inlet sensor 14*a* of this embodiment is of a penetration type including a light-emitting section and a light-receiving section with the convey passage therebetween, it may be of a reflection type.

Figure 3A:
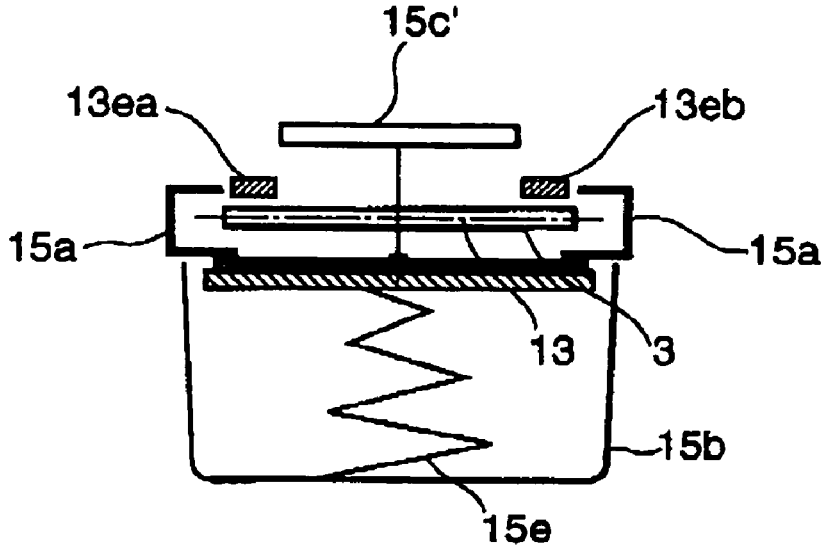
FIGS. 3A to 3C are plan views illustrating an operation of a keeping bill storage section provided in the machine body of the bill handling machine shown in FIG. 1.

A keeping bill storing section 15 for storing only bills other than dischargeable bills which are distinguished by the distinguishing sensors 14*b* and 14*c* is disposed in the position where the conveying belt 13*e* is provided. The keeping bill storing section 15 includes a pair of recessed members 15*a* having a recess into which the widthwise side of the bill 3 which is conveyed on the convey passage 13 is fitted (refer to FIG. 3A), a storing chamber 15*b* opened to the convey passage 13 (refer to FIGS. 3B and 4), a pushing mechanism 15*c* including a push plate 15*c*' for pushing a bill 3 on the convey passage 13 into the storing chamber 15*b*, a push plate 15*d* for pushing the widthwise opposite ends of the bill 3 pushed into the storing chamber 15*b* by the pushing mechanism 15*c* to the recessed members 15*a*, and a coil spring 15*e* provided between the push plate 15*d* and the bottom of the storing chamber 15*b*. A known pusher is used as the pushing mechanism 15*c* (shown in Japanese Unexamined Patent Publication No. 9-16829), in which a stack motor M2 is used to drive it in this embodiment. As shown in FIG. 3A, the conveying belt 13*e* includes belts 13*ea* and 13*eb* in contact with the opposite ends of the bill 3, between which the push plate 15*c*' passes in the direction of the arrow.

Figure 3B:
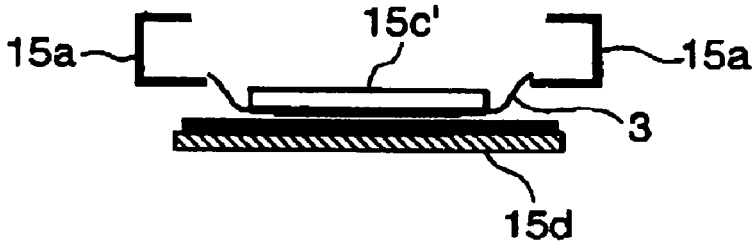
Figure 3C:
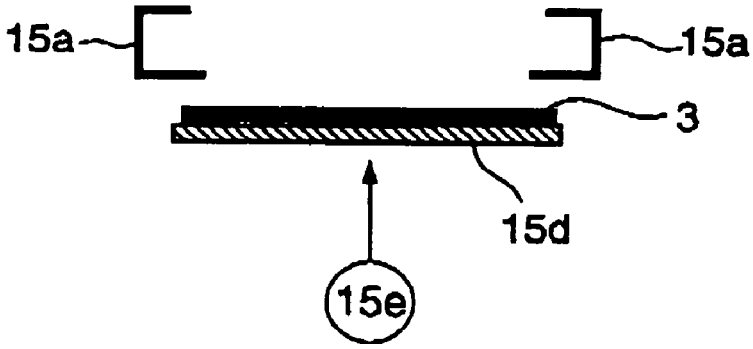
Figure 4:
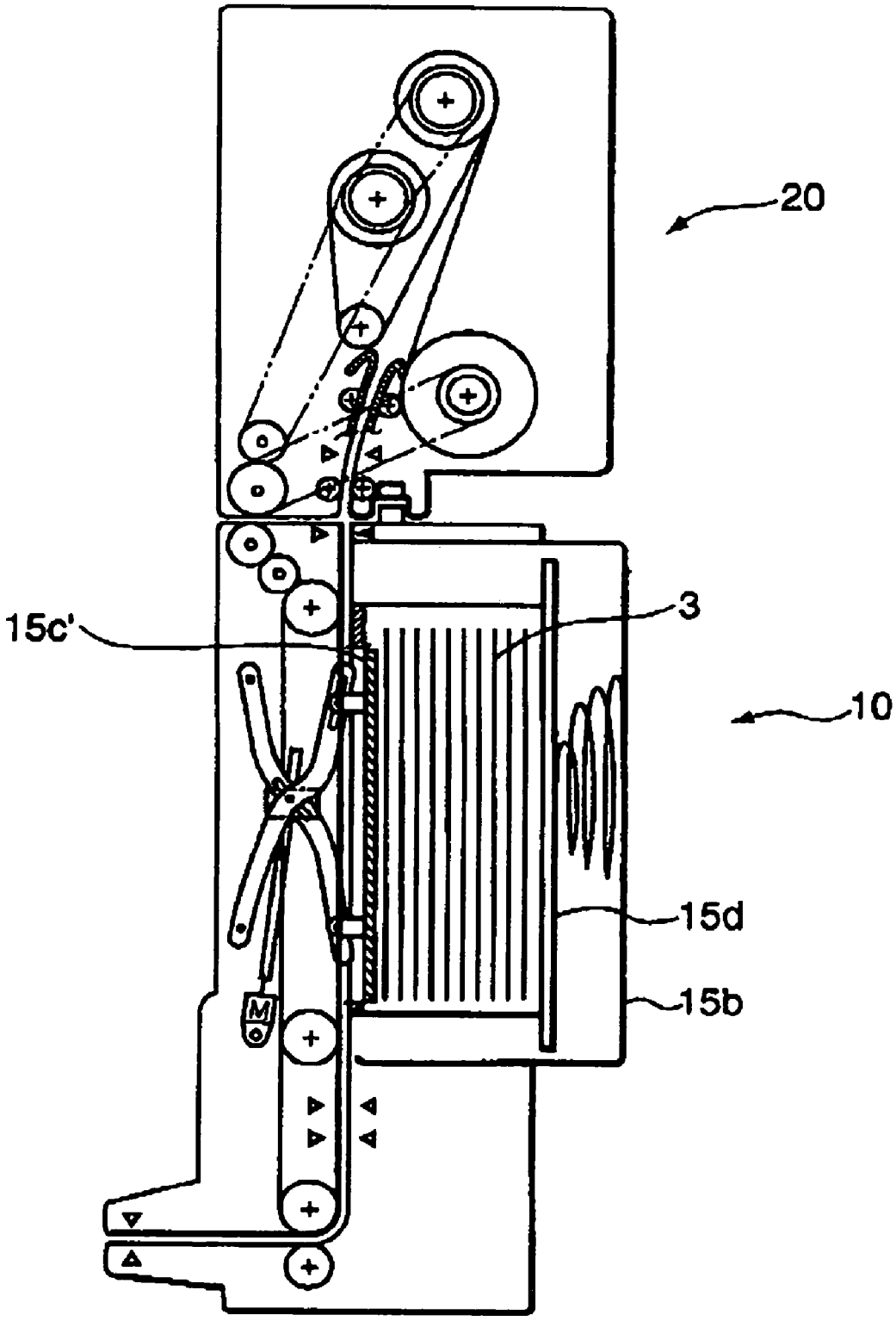
FIG. 4 is a side sectional view illustrating the operation of the keeping bill storage section provided in the machine body of the bill handling machine shown in FIG. 1.

The bill storing operation of the keeping bill storing section 15 is performed as shown in FIGS. 3 and 4. Specifically, the center of the bill 3 of which the opposite ends are held by the pair of recessed members 15*a*, as shown in FIG. 3A, is pushed with the push plate 15*c*' of the pushing mechanism 15*c*, as shown in FIGS. 3B and 4, to push the bill 3 into the storing chamber 15*b*, and the widthwise opposite ends of the bill 3 are pushed to the recessed members 15*a* with the push plate 15*d* and the coil spring 15*e*, as shown in FIG. 3C.

The bill 3 stored in the keeping bill storing section 15 in that way is a bill other than dischargeable bills. The dischargeable bills are not stored in the keeping bill storing section 15 but conveyed to the mounting section 11 by the first conveying device 12. An outlet sensor 18 of, for example, a penetration type is provided in the vicinity of the outlet of the convey passage 13. The outlet sensor 18 senses arrival of the bill 3 to the mounting section 11, and outputs the detection signal to the controller device 30.

The opposing rollers 13*a* and 13*b* and the roller 13*c* disposed adjacent to the mounting section 11 relative to those are of a passive type. The distance from the slot 2 to the roller 13*c* is set shorter enough than the length of the bill 3, thus allowing the convey of the bill 3 by holding the leading end of the inserted bill 3 between the roller 13*c* and the conveying belt 13*d*.

Figure 10:
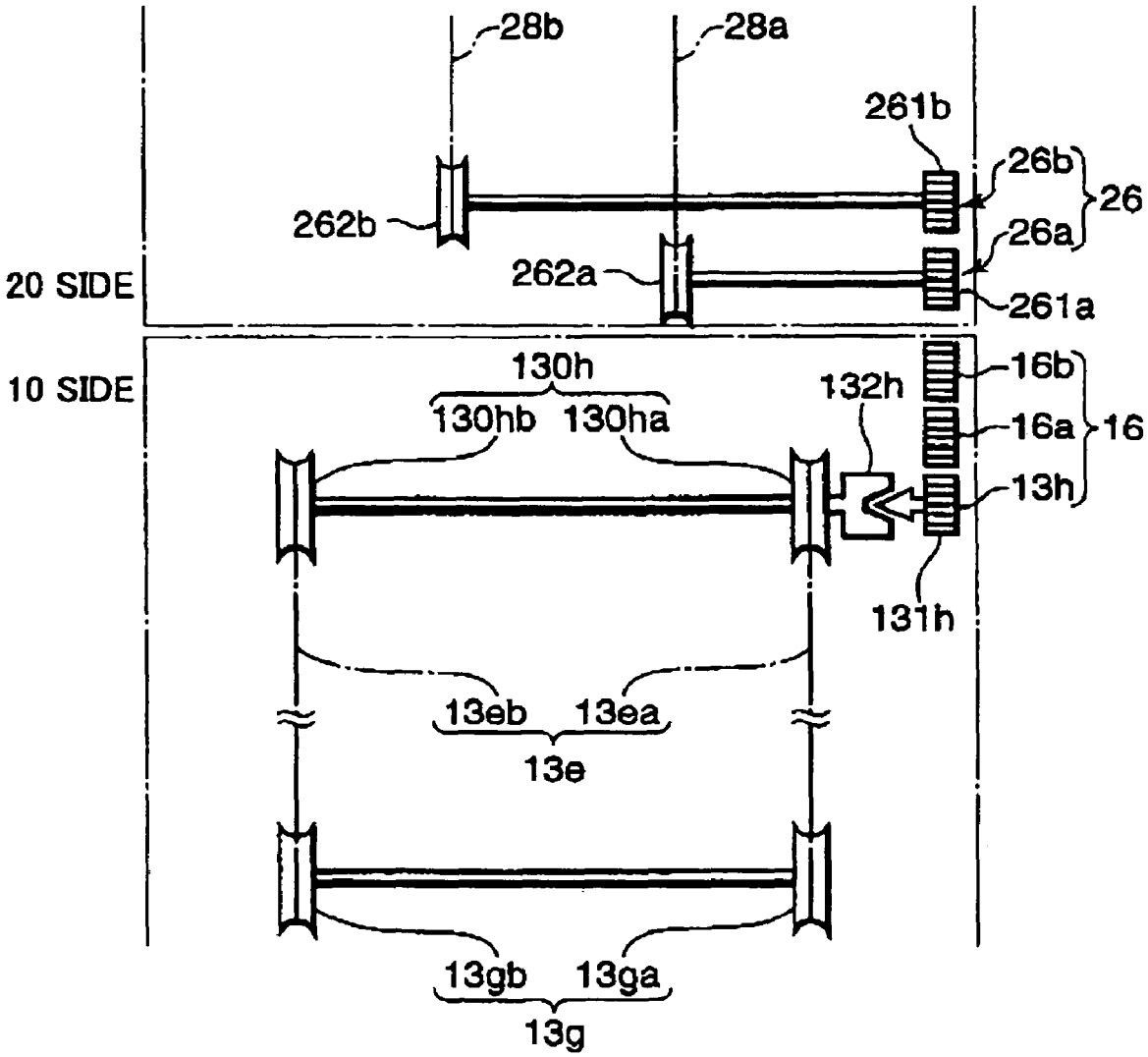
FIG. 10 is a schematic diagram showing a portion near to a torque transmission unit and a torque receiving unit provided in the bill handling machine shown in FIG. 1.

Referring to FIG. 10, the common pulley 13*g* adjacent to the mounting section 11 relative to the roller 13*c* includes two pulleys 13*ga* and 13*gb* coaxial with the belts 13*ea* and 13*eb*, respectively, in correspondence therewith. A driven pulley unit 13*h* is in the form of a gear clutch having a clutch, and includes a pulley group 130*h* having two coaxial pulleys 130*ha* and 130*hb*, a gear 131*h* coaxial with the pulley group 130*h*, and a clutch 132*h* disposed therebetween. The belt 13*ea* is stretched between the pulley 130*ha* and the pulley 13*ga*, while the belt 130*hb* is stretched between the pulley 130*hb* and the pulley 13*gb*.

The gear 131*h* of the pulley unit 13*h* is engageable with a gear 16*a*, one of two gears 16*a* and 16*b* in engagement with each other. The two gears 16*a* and 16*b* and the pulley unit 13*h* constitute an active torque transmission unit 16 serving as part of the first conveying device 12. The gear 16*b* is partially exposed to the mounting section 11.

The mounting section 11 has a connector 17 protruding therefrom. The connector 17 supplies electricity from the machine body 10 to the detachable box 20, and transmits and receives a signal bidirectionally between the machine body 10 and the detachable box 20.

The detachable box 20 stores and discharges bills. All the detachable boxes 20 have the same structure. The mounted section 21 disposed at the lower part has a recess 21*a* into which the connector 17 is fitted. The connector 17 is inserted into the recess 21*a*, so that the detachable box 20 is mounted in position of the machine body 10.

Each detachable box 20 includes an opposing connector 22 provided to the recess 21*a* and electrically connected to the connector 17, a second conveying device 24 having a convey passage 23 for leading a bill conveyed by the first conveying device 12, a dischargeable bill storage section 25 for storing the bill led by the convey passage 23 so as to discharge it, a passive torque transmission unit 26 provided to the mounted section 21 and receiving the driving force from the active torque transmission unit 16, and a second passage sensor 27 of, for example, a penetration type provided in the vicinity of the inlet of the convey passage 23. The second passage sensor 27 detects the passage of a bill and outputs a detection signal to the controller device 30.

The opposing connector 22 is mounted to the machine body 10 of the detachable box 20 to be electrically connected to the connector 17, receiving electricity from the machine body 10 to the detachable box 20, and transmitting and receiving a signal bidirectionally between the machine body 10 and the detachable box 20.

The inlet of the convey passage 23 of the second conveying device 24 is joined with the convey passage 13 by mounting the detachable box 20 to the machine body 10. The second conveying device 24 includes multiple pairs of opposing rolls 24*a* and 24*b* disposed to face the convey passage 23.

The dischargeable bill storage section 25 is disposed at the outlet of the convey passage 23. The dischargeable bill storage section 25 includes belt-letting-out/winding device 25*c* and 25*d* for separately letting out and separately winding two bill-holding belts 25*a* and 25*b* from the opposite sides so as to sandwich the outlet of the convey passage 23 therebetween and a belt-winding/letting-out device 25*e* for winding and letting out the bill-holding belts 25*a* and 25*b* together. The belt-letting-out/winding device 25*d* includes a guide roll 25*f* for guiding the belt 25*b* in a different direction.

The belt-letting-out/winding device 25*c* and 25*d* hold the bill that has reached the outlet of the convey passage 23 between the let-out bill-holding belts 25*a* and 25*b*, while the belt-winding/letting-out device 25*e* winds the bill-holding belts 25*a* and 25*b* together. On the other hand, in discharge, the belt-winding/letting-out device 25*e* lets out the bill-holding belts 25*a* and 25*b* together, while the belt-letting-out/winding device 25*c* and 25*d* separately wind the bill-holding belts 25*a* and 25*b* to release the bill held by the bill-holding belts 25*a* and 25*b* and sent it to the outlet of the convey passage 23. The outlet of the convey passage 23 has a trumpet-shape member 23*a* with the end adjacent to the dischargeable bill storage section 25 being wide, ensuring reception of a bill discharged from the dischargeable bill storage section 25.

Figure 5:
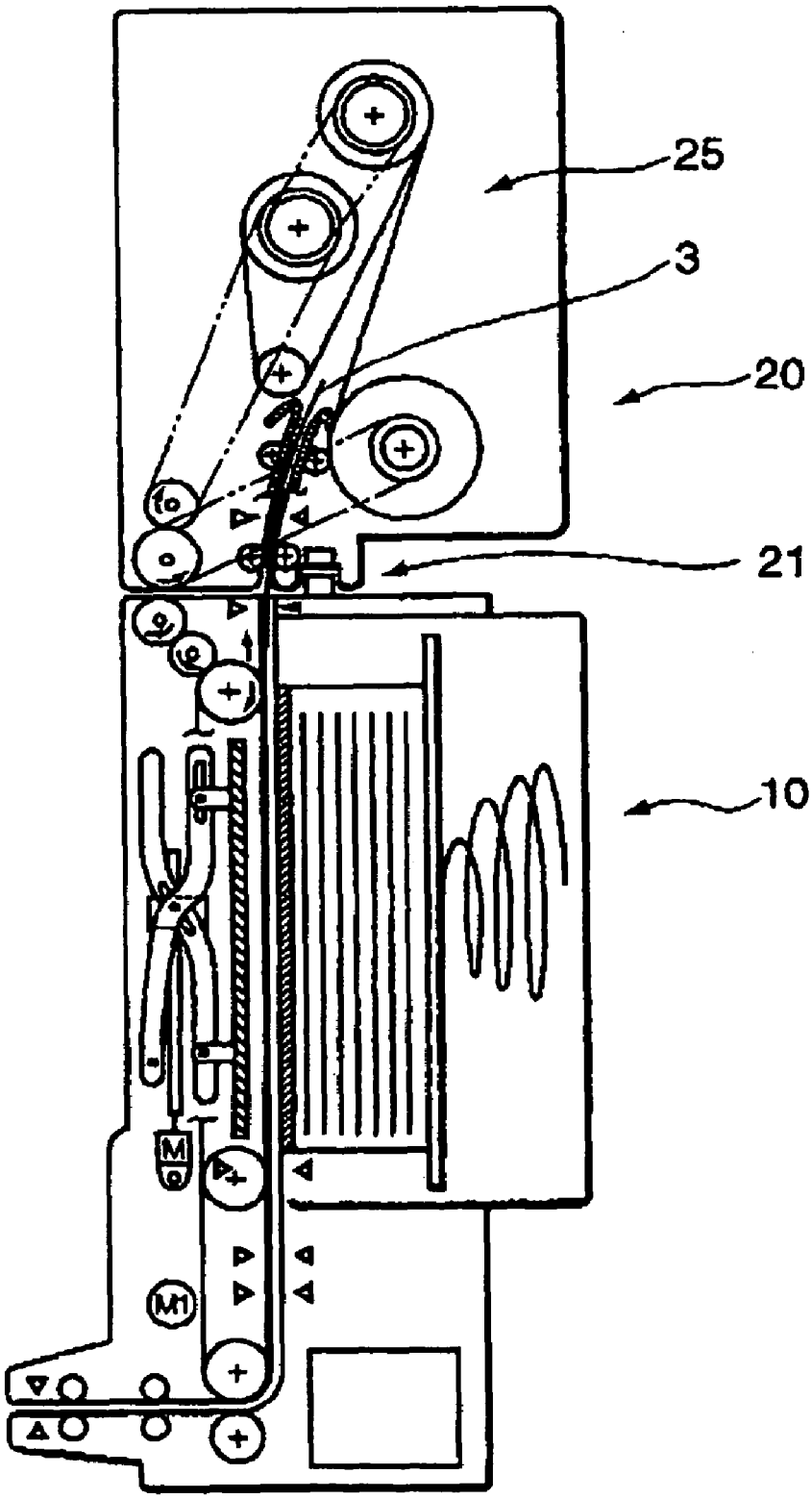
FIG. 5 is a side sectional view illustrating a bill discharging operation of a dischargeable bill storage section provided in the detachable box of the bill handling machine shown in FIG. 1.

The passive torque transmission unit 26 drives the dischargeable bill storage section 25 and is brought into engagement with the active torque transmission unit 16 by mounting the detachable box 20 to the machine body 10, as shown in FIG. 10, and has two pulley gears 26*a* and 26*b* in this embodiment. The pulley gear 26*a* has a gear 261*a* exposed to the mounted section 21 and is brought into engagement with the gear 16*b* exposed to the mounting section 11 by mounting the detachable box 20 to the machine body 10, which rotates the pulley gear 26*a*, thereby rotating the pulley gear 26*b* having a gear 261*b* concentric therewith and brought into engagement with the gear 261*a*. A belt 28*a* is stretched between a pulley 262*a* of the pulley gear 26*a* and the belt-letting-out/winding device 25*c*, while a belt 28*b* is stretched between a pulley 262*b* of the pulley gear 26*b* and the belt-letting-out/winding device 25*d*. Furthermore, a belt 28*c* is stretched between the belt-letting-out/winding device 25*d* and the belt-winding/letting-out device 25*e*. With the rotation of the pulley gear 26*a*, the belt-letting-out/winding device 25*c* and 25*d* and the belt-winding/letting-out device 25*e* are rotated. When the pulley gear 26*a* rotates clockwise with the rotation, the dischargeable bill storage section 25 stores the bill 3 that has reached the mounted section 21; when the pulley gear 26*a* rotates counterclockwise, the dischargeable bill storage section 25 discharges the bill 3 to the mounted section 21, as shown in FIG. 5.

When a clutch 132*h* of the pulley unit 13*h* is in engagement, the dischargeable bill storage section 25 stores and discharges the bill by the above operation. On the other hand, when the clutch 132*h* is out of engagement, the torque of the pulley group 130*h* is not transmitted to the gear 131*h* even when the gear 131*h* is in engagement with the pulley gears 26*a* and 26*b* of the passive torque transmission unit 26, so that the dischargeable bill storage section 25 does not operate. The torque of the pulley 262*a* of the pulley gear 26*a* is transmitted to the opposing rolls 24*a* and 24*b* via a belt (not shown) when the clutch 132*h* is in engagement, so that the opposing rolls 24*a* and 24*b* send the bill 3 in normal and reverse directions.

A trailing-end detection sensor 29 for optically detecting, for example, a winding-end mark (not shown) attached to the bill-holding belt 25*a* is provided in the vicinity of the belt-letting-out/winding device 25*c*. When the trailing-end detection sensor 29 detects the winding-end mark, its detection signal is given to the controller device 30. The controller device 30 thus lights on an alarm lamp (not shown) and controls the belt-letting-out/winding device 25*c* to continue to wind bills until the detection and finish the following winding (not to wind the following bill). In other words, the winding-end mark is set in the position where the dischargeable bill storage section 25 is full of bills. The set position, however, may be a position where the dischargeable bill storage section 25 is nearly filled.

The trailing-end detection sensor 29 and the second passage sensor 27 are operated by electricity supplied through the connected connector 17 and opposing connector 22. The winding-end mark (not shown) may be provided to the bill-holding belt 25*b* and the trailing-end detection sensor 29 maybe disposed in the vicinity of the belt-letting-out/winding device 25*d*.

Figure 6:
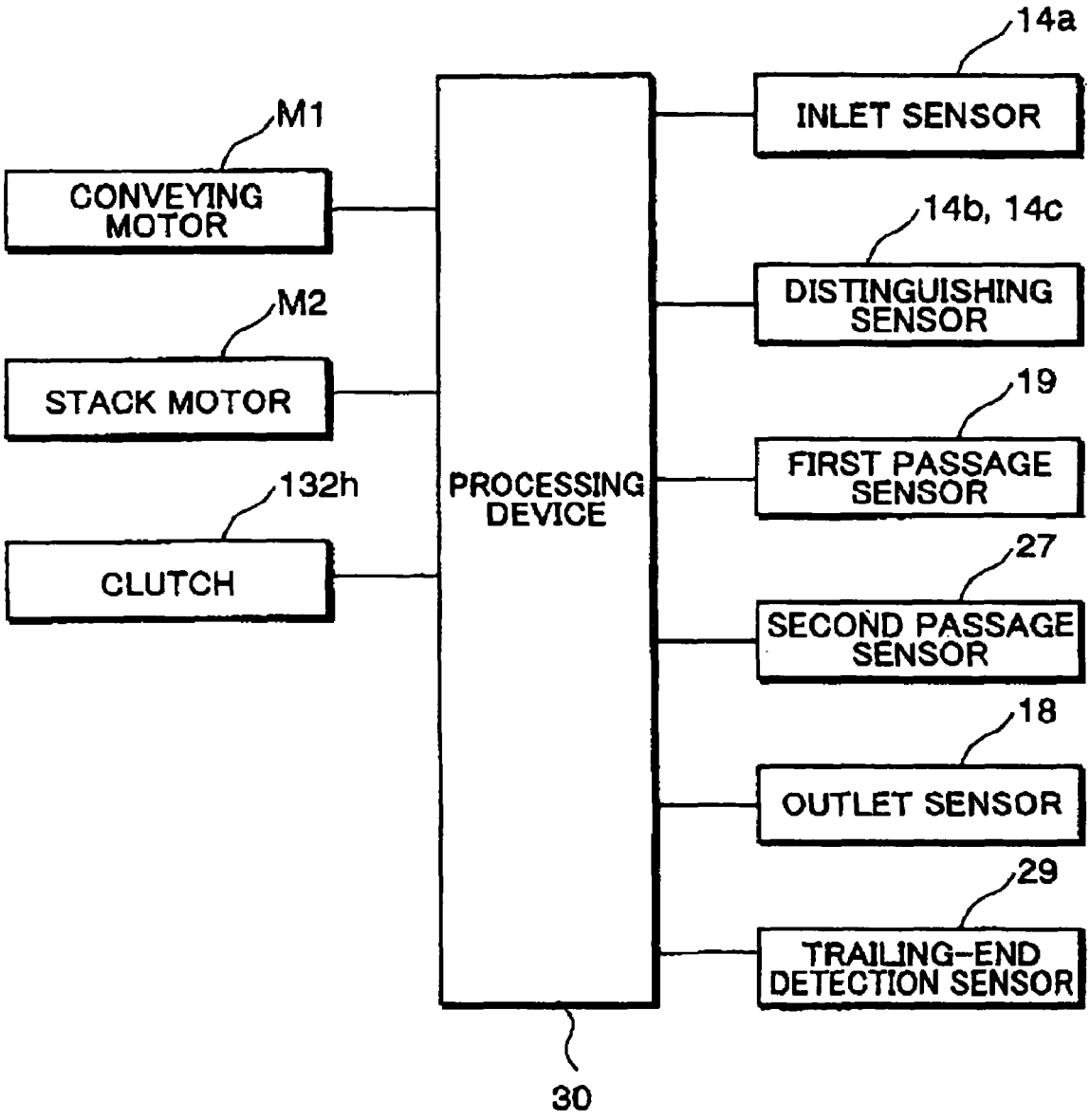
FIG. 6 is a control block diagram showing a controller device provided in the bill handling machine shown in FIG. 1.

FIG. 6 is a control block diagram of the controller device 30. The controller device 30 includes a CPU, an ROM, and an RAM. The controller device 30 inputs signals from the inlet sensor 14*a*, the distinguishing sensors 14*b* and 14*c*, the first passage sensor 19, and the outlet sensor 18, which are disposed to the machine body 10, and also inputs detection signals from the second passage sensor 27 and the trailing-end detection sensor 29 provided to the detachable box 20 via the electrically connected connector 17 and the opposing connector 22. When the amount of a given bill distinguished by the distinguishing sensors 14*b* and 14*c* is larger than a specified amount, the controller device 30 calculates the number of change bills 3 and the controls the conveying motor M1 and the stack motor M2 and the engagement and disengagement of the clutch 132*h* of the pulley unit 13*h*.

Figure 7A:
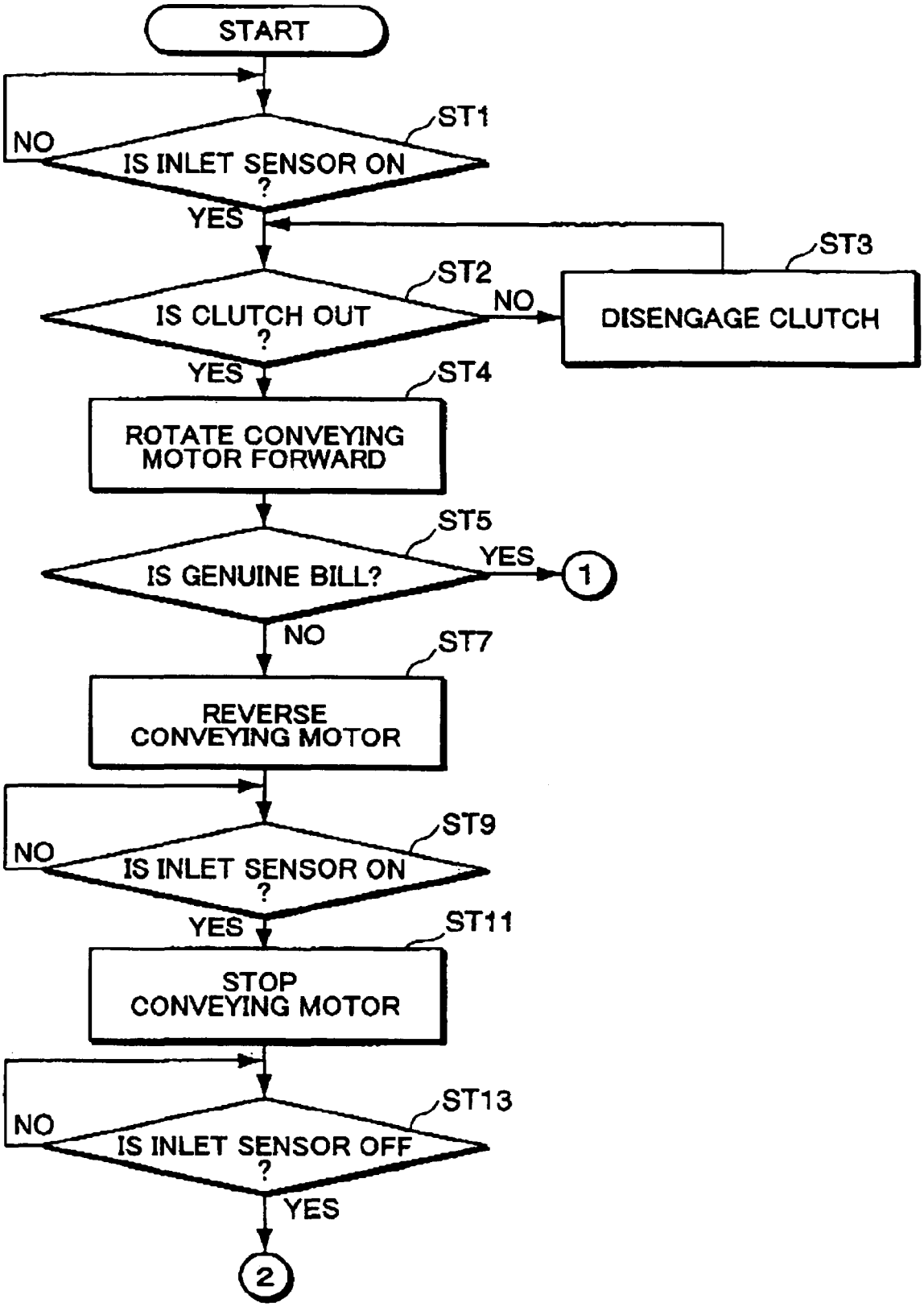
FIG. 7 is a flowchart showing a bill receiving operation (money insertion) carried out by the bill handling machine shown in FIG. 1.
Figure 7B:
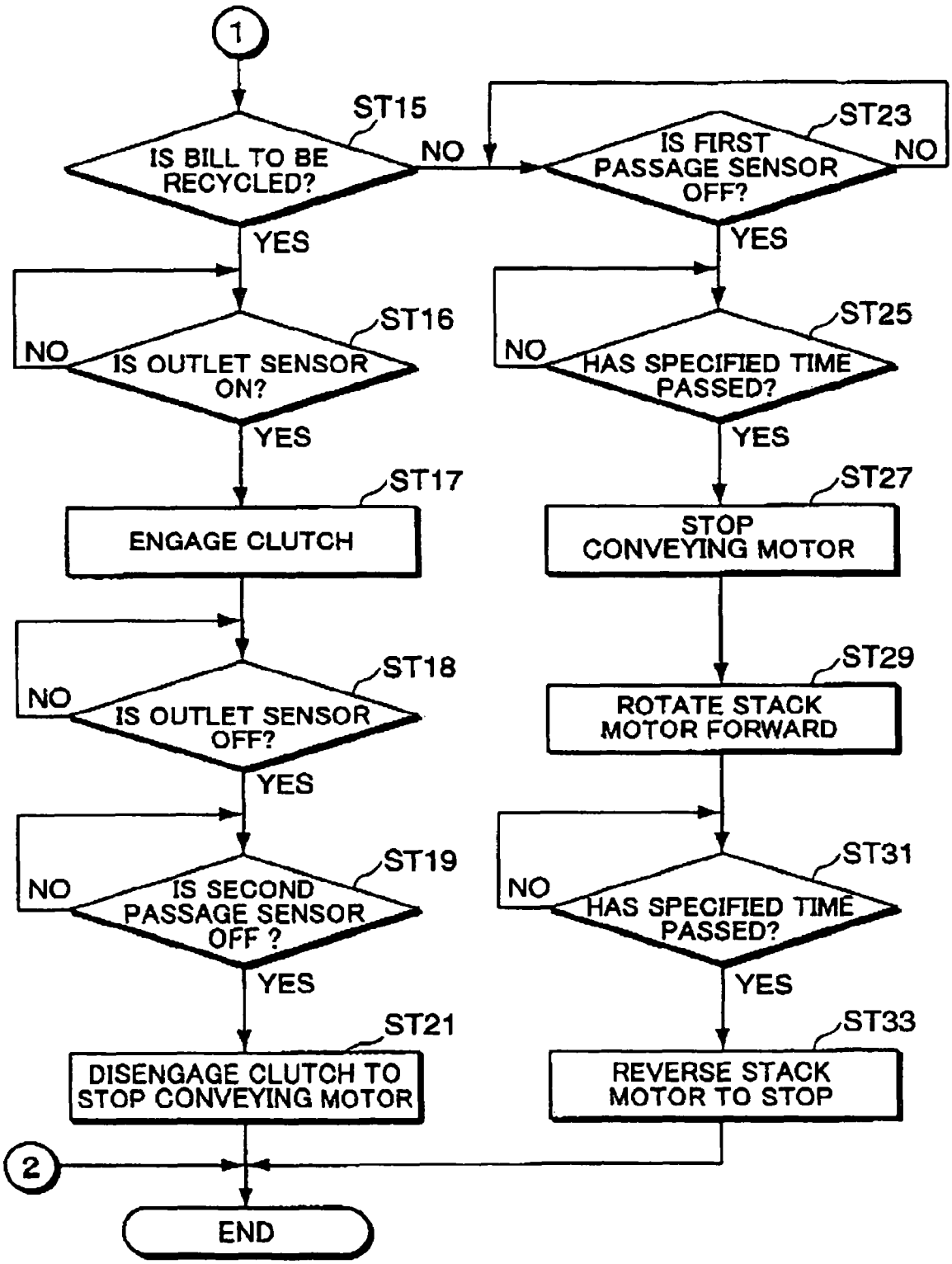

FIG. 7 is a flowchart for the bill receiving operation (money-receiving process).

At the start of money-receiving process, the controller device 30 determines whether or not the inlet sensor 14*a* is ON (step ST1). When the inlet sensor 14*a* is ON, the controller device 30 then determines whether the clutch 132*h* is out of engagement (step ST2) When the clutch 132*h* is not out of engagement, the clutch 132*h* is brought out of engagement (step ST3). When the clutch 132*h* is out of engagement, the conveying motor M1 is rotated in a normal direction to convey the bill to the interior (step ST4). The controller device 30 then determines whether the given bill 3 is genuine or not according to the signal from the distinguishing sensors 14*b* and 14*c* (step ST5). When it is not true, the conveying motor M1 is reversed to return the bill 3 to the slot 2 (step ST7) and then it is determined whether or not the inlet sensor 14*a* is ON (step ST9) When the inlet sensor 14*a* is ON, the conveying motor M1 is stopped after a lapse of specified time to convey the bill 3 to a position where the bill 3 can be drawn out (step ST11). It is then determined whether or not the inlet sensor 14*a* is OFF (step ST13). When the inlet sensor 14*a* is turned off by drawing out the bill 3, the procedure is finished.

On the other hand, in step ST5, it is determined that the given bill 3 is true, it is then determined whether it is a dischargeable bill or not (a bill to be recycled) (step ST15) When it is a dischargeable bill, it is determined whether the outlet sensor 18 has been turned on (step ST16). In other words, it is determined whether or not the bill 3 has reached the outlet sensor 18. When the outlet sensor 18 is turned on, the clutch 132*h* is brought into engagement from disengagement (step ST17). Subsequently, it is determined whether or not the outlet sensor 18 has been turned off (step ST18). In other words, it is determined whether or not the bill 3 that has already reached the outlet sensor 18 has passed through the outlet sensor 18. After the outlet sensor 18 has been turned off, it is determined whether or not the second passage sensor 27 has been turned off (step ST19). When the second passage sensor 27 is turned off by the passage of the bill 3, the clutch 132*h* is switched from IN to OUT and the conveying motor M1 is stopped (step ST21) and the procedure is finished. At that time, the dischargeable bill storage section 25 is stopped such that the trailing end of the bill 3 is located immediately close to the second passage sensor 27.

When the following dischargeable bill is given, the same control is performed as before. When the outlet sensor 18 is turned on with the dischargeable bill, the clutch 132*h* is switched from OUT to IN to start the operation of the dischargeable bill storage section 25. Accordingly, this bill is stored with a specified distance from the preceding bill. Accordingly, the bills stored in the dischargeable bill storage section 25 at the last time and this time are held between the belts 25*a* and 25*b* at about an interval according to the separation distance between the second passage sensor 27 and the outlet sensor 18.

In step ST15, when the bill 3 is other than a dischargeable bill, it is determined whether or not the first passage sensor 19 is OFF (whether or not the trailing end of the bill has passed) (step ST23); briefly, it is determined whether or not the bill has reached the keeping bill storing section 15. When it is determined to be OFF, it is determined whether or not a specified time has passed (step ST25). After a lapse of the specified time, the conveying motor M1 is stopped (step ST27), and then the stack motor M2 is rotated in a normal direction in order to store the bill 3 in the keeping bill storing section 15 (step ST29) and it is determined whether or not a specified time has passed (step ST31). After a lapse of the specified time, the stack motor M2 is rotated reversely in order to return the keeping bill storing section 15 to the initial state and then stopped (step ST33). The procedure is then finished. It is preferable to provide, for example, a shutter in the vicinity of the slot 2 to prevent the charge of the following bill until the completion of the process of receiving a dischargeable bill in steps ST15 to 21 and the process of receiving the dischargeable bill in steps ST23 to 33.

Figure 8:
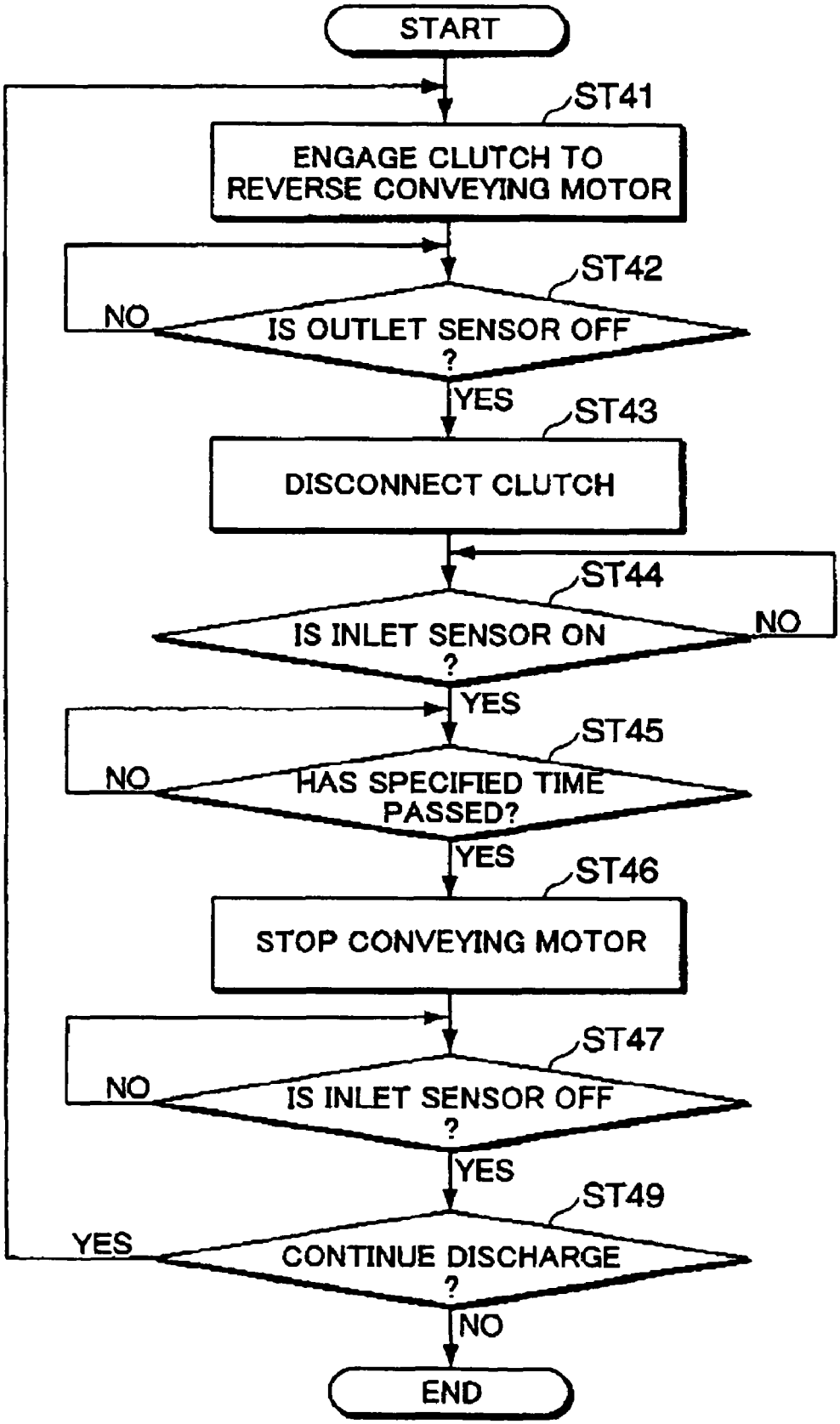
FIG. 8 is a flowchart showing a discharging operation of the bill handling machine shown in FIG. 1.
Figure 9:
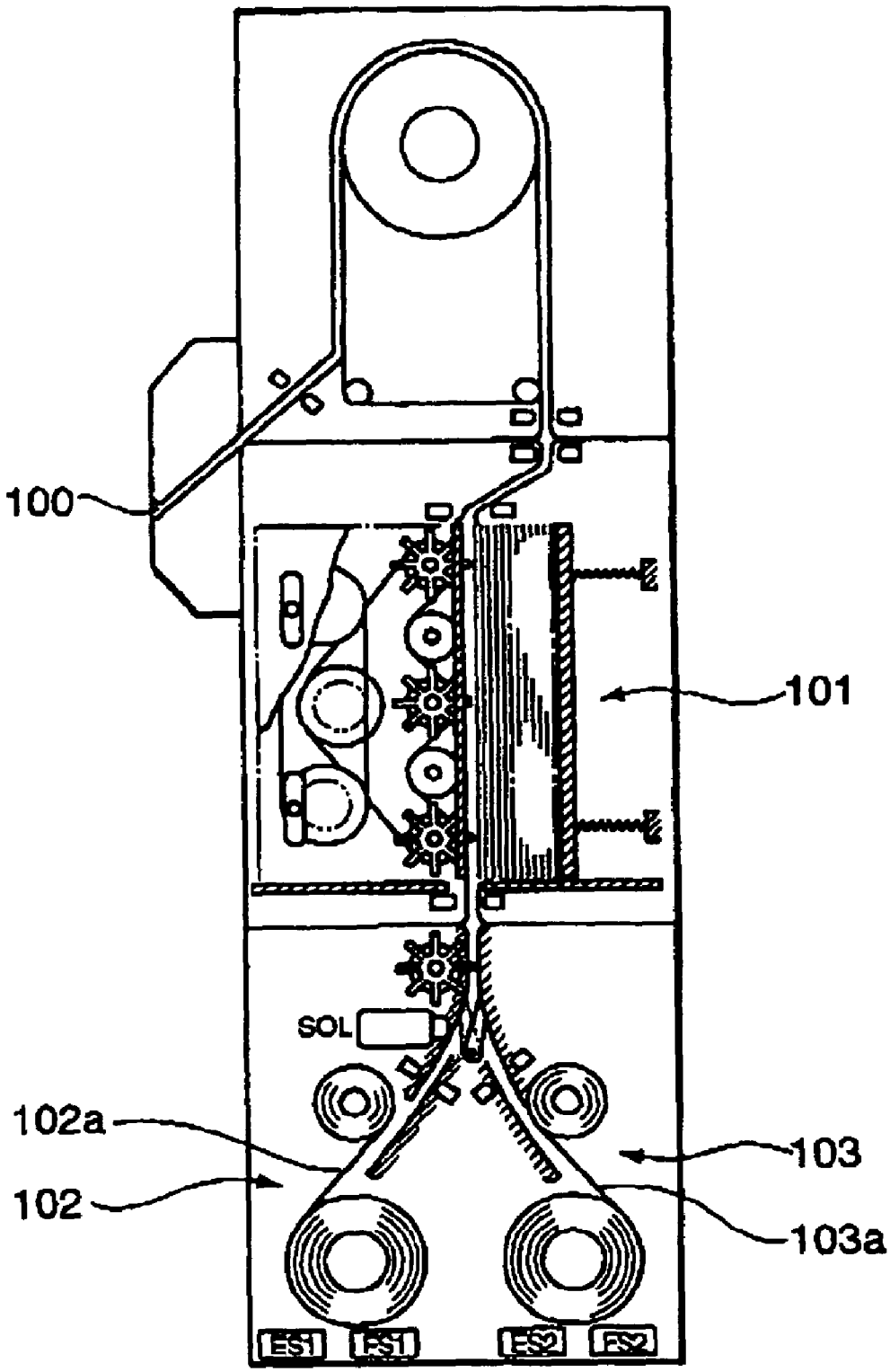
FIG. 9 is a side sectional view of a conventional bill handling machine.

FIG. 8 is a flowchart for the discharging operation.

At the start of the discharging operation, the controller device 30 switches the clutch 132*h* from IN to OUT and reverses the rotation of the conveying motor M1 (step ST41) to discharge the stored bill from the dischargeable bill storage section 25 and thereafter it determines whether or not the outlet sensor 18 has been turned from ON (the bill is detected) to OFF (the trailing end of the dischargeable bill is detected) (step ST42). When it is turned off, the clutch 132*h* is switched from IN to OUT (step ST43). Specifically, the bill discharged at an interval corresponding to the separation distance between the second passage sensor 27 and the outlet sensor 18 is stopped so that the leading end is located in the vicinity of the second passage sensor 27 even when the preceding bill has passed through the outlet sensor 18, and the convey operation of the machine body 10 and that of the detachable box 20 are separated to allow the preceding dischargeable bill by the machine body 10 with the following bill held in standby mode in the detachable box 20.

It is then determined whether the inlet sensor 14*a* has been turned on, or whether or not the dischargeable bill has reached the slot 2 (step ST44). After it has been turned on, it is determined whether or not a specified time has passed (step ST45). When the specified time has passed, the conveying motor M1 is stopped (step ST46).

Subsequently, it is determined whether or not the inlet sensor 14*a* has been turned off, or whether or not the bill has been drawn out (step ST47). When the inlet sensor 14*a* has been turned off, it is then determined whether or not the discharging operation is continued, i.e., whether or not a second or further change is needed (step ST49) When it is not necessary, the procedure is finished. On the other hand, when the second or further change is necessary, the procedure of steps ST41 to 49 is repeated by the number of times corresponding to the number of bills to be discharged. When the continuance of the discharging operation becomes unnecessary, the procedure is finished.

The repetition of steps ST41 to 49 by the number of times corresponding to the number of bills to be discharged, as described above, offers the advantage of preventing excess discharge of bills and also preventing discharge of more than one bills in stacked condition because the bills are certainly discharged one by one. This process may be performed such that when a shutter is provided in the vicinity of the slot 2, as described above, for example, when the outlet sensor 18 is turned off in step ST42, the shutter which has been closed until that time is opened and, when the dischargeable bill is only one, the shutter is closed when the inlet sensor 14*a* is turned off in step ST47, while when the dischargeable bill is more than one, the shutter is closed when the inlet sensor 14*a* is turned off for the last bill. The timing when the shutter is closed may not the time when the outlet sensor 18 is turned off but may depend on the detection of the second passage sensor 27 or the detection of the sensors of the machine body 10.

When the trailing-end detection sensor 29 detects the winding-end mark during the money-receiving process and the discharging operation, the controller device 30 lights on an alarm lamp (not shown) and controls the process to continue to wind the bills until the detection and not to wind the following bills.

Accordingly, in the bill handling machine, when the detachable box 20 is full of bills 3 or in a state close to that, the detachable box 20 is detached from the machine body 10; instead, a different detachable box 20 with the same structure is attached and bills in the detached detachable box 20 are drawn out quickly by using a bill collecting device separately prepared. Accordingly, even if bills in the detached detachable box 20 are bent or curled bills which may cause bill jamming, the occurrence of bill jamming in the bill handling machine 1 can be prevented since the bills are collected outside the bill handling machine 1. This eliminates the necessity of recovery because of the occurrence of bill jamming, allowing quick bill-handling operation. Although the embodiment has been described which includes the multiple detachable box 20 by way of example, the invention is not limited to that and can be applied to the case of including only one detachable box 20. In that case, the bills in the detached detachable box 20 can be drawn out using a separately prepared bill collecting device and the detachable box 20 can be attached to the machine body 10. This also offers the same advantages as those of the case of including the multiple detachable boxes 20.

According to the embodiment, the machine body 10 includes the active torque transmission unit 16 at the mounting section 11, which makes up part of the first conveying device 12; and the detachable box 20 includes the passive torque transmission unit 26 at the mounted section 21, which is brought into engagement with the active torque transmission unit 16 to drive the dischargeable bill storage section 25. The active torque transmission unit 16 and the passive torque transmission unit 26 are brought into engagement with each other by mounting the detachable box 20 to the machine body 10 and brought out of engagement by detachment. Accordingly, even when another detachable box 20 is mounted to the machine body 10 in place of the full detachable box 20, as described above, the dischargeable bill storage section 25 in there placed detachable box 20 can be operated through the active torque transmission unit 16 and the passive torque transmission unit 26.

According to the embodiment, the machine body 10 has the connector 17 at the mounting section 11, while the detachable box 20 has the opposing connector 22 electrically connected to the connector 17 by being mounted to the machine body 10. Electricity is supplied from the machine body 10 to the trailing-end detection sensor 29 and the second passage sensor 27 of the detachable box 20 by electrical connection of the connectors 17 and 22. Accordingly, also when another empty detachable box 20 is mounted to the machine body 10 in place of the full detachable box 20, as described above, electricity can be supplied from the machine body 10 to the trailing-end detection sensor 29 and the second passage sensor 27 of the replaced detachable box 20 through the electrically connected connectors 17 and 22.

According to the embodiment, the pulley unit 13*h* includes the clutch 132*h*. The driving force to the dischargeable bill storage section 25 can be shut off with the active torque transmission unit 16 and the passive torque transmission unit 26 in engagement with each other. Accordingly, when a bill received through the slot 2 is a specified dischargeable bill (a bill to be recycled), after the bill is stored in the dischargeable bill storage section 25 of the detachable box 20 and then the clutch 132*h* is brought out of engagement, so that the storing operation of the detachable box 20 and the bill-convey and storing operations of the machine body 10 can be separated.

According to the embodiment, the engagement and disengagement of the clutch 132*h* are performed according to the inlet sensor 14*a* provided in the vicinity of the slot 2 of the convey passage 13 in the machine body 10, the outlet sensor 18 provided in the vicinity of the outlet of the convey passage 13, and the second passage sensor 27 provided in the vicinity of the inlet of the convey passage 23 of the detachable box 20. When the bill is stored in the dischargeable bill storage section 25, upon the trailing end of a bill passing through the second passage sensor 27, the clutch 132*h* is disengaged and, upon the leading end of the following bill to be stored passing through the outlet sensor 18, the clutch 132*h* is engaged. Accordingly, the separation distance between the trailing end of the bill that is stored in the dischargeable bill storage section 25 immediately before and the leading end of the bill that is stored later can be provided at a specified interval corresponding to the separation distance between the second passage sensor 27 and the outlet sensor 18, thereby improving the efficiency in storage.

According to the embodiment, the engagement and disengagement of the clutch 132*h* are performed according to the inlet sensor 14*a*, the outlet sensor 18, and the number of bills to be discharged, which is calculated by the controller device 30. When a bill is discharged from the dischargeable bill storage section 25, upon the trailing end of the bill passing through the outlet sensor 18, the clutch 132*h* is disengaged, and upon the trailing end of the bill passing through the inlet sensor 14*a*, the clutch 132*h* is engaged. When the trailing end of the bill has passed through the outlet sensor 18, the following bill is brought into standby mode in the detachable box 20, in which state the preceding bill is discharged to the slot 2 of the machine body 10. When the trailing end of the preceding bill has passed through the inlet sensor 14*a*, i.e., it has been discharged, the clutch 132*h* is brought into engagement to allow the following dischargeable bill similarly. Since the number of engagement and disengagement of the clutch 132*h* corresponds to the number of bills to be discharged, excess payment of bills can be prevented.

Although the embodiment has a structure in which the pulley unit 13*h* that makes up the active torque transmission unit 16 includes the clutch 132*h*, the invention is not limited to that. For example, the gears 16*a* and 16*b* and the gear 131*h* of the pulley unit 13*h*, which make up the active torque transmission unit 16, may have a clutch in the corresponding position; alternatively, the passive torque transmission unit 26 opposite to the active torque transmission unit 16 may have a clutch or, both the active torque transmission unit 16 and the passive torque transmission unit 26 may each have a clutch. In other words, the clutch can be disposed in any position as long as when the received bill is a specified dischargeable bill (a bill to be recycled), the operation of storing the bill into the dischargeable bill storage section of the detachable box and the bill-convey and storing operation of the machine body can be separated and, the operation of the detachable box and the operation of the machine body can be separated while the bill stored in the dischargeable bill storage section is conveyed in the machine body, in which case the clutch can have any structure suitable for the mounting position.

According to the embodiment, although the active torque transmission unit 16 includes the pulley unit 13*h* and the two gears 16*a* and 16*b*, while the passive torque transmission unit 26 includes the two pulley gears 26*a* and 26*b*, the invention is not limited to that. For example, the active torque transmission unit may have a structure in which one or both of the gears 16*a* and 16*b* are omitted or, alternatively, another gear or transmission device is added as long as the driving force of the machine body can be transmitted to the dischargeable bill storage section of the detachable box, while the passive torque transmission unit may have a structure in which one of the pulley gears 26*a* and 26*b* is omitted or, alternatively, the pulley gear is replaced with another transmission device.

According to the embodiment, the dischargeable bill storage section of the detachable box is driven by bringing the active torque transmission unit that makes up part of the first conveying device into engagement with the passive torque transmission unit of the detachable box. However, the invention is not limited to that. For example, the detachable box may be provided with a separate drive motor, which is driven by electricity supplied from the machine body to activate the dischargeable bill storage section because electricity can be sent and received therebetween by connecting the connector of the machine body with the opposing connector of the detachable box. The invention can be applied to the operation of other sensors and electrical devices, if mounted, not only to the energization to the trailing-end detection sensor and the second passage sensor. Furthermore, the connection of the connector of the machine body with the opposing connector of the detachable box allows signals to be sent and received therebetween.

Although the embodiment has a structure in which the fulfillment of the detachable box with bills is detected by the detection of a winding-end mark by the trailing-end detection sensor, the invention is not limited to that. The following examples are given: a system in which a sensor for sensing the winding thickness of the bill-holding belt of the belt-winding/letting-out device 25*e* is disposed at the winding position of the bill-holding belt to determine the fulfillment condition of the detachable box; and a system in which the fulfillment of the detachable box with bills is detected by calculating the number of wound bills from the number of the normal and reverse rotations of the belt-winding/letting-out device 25*e* or the belt-letting-out/winding device 25*c* and 25*d* and the number of times of detection by the first and second passage sensors 19 and 27.

Although the embodiment includes one dischargeable bill storage section in the detachable box because the kind of dischargeable bill is one, the invention is not limited to that. When the kind of dischargeable bill is two or more, the dischargeable bill storage sections of a number corresponding to the kind of the dischargeable bill may be disposed in an identical detachable box or, alternatively, detachable boxes of a number corresponding to the kind of bill, each including one dischargeable bill storage section, may be detachably mounted to the machine body.

Although the embodiment employs a system in which the dischargeable bill storage section provided to the detachable box stores and discharges bills by winding and rewinding, the invention is not limited to that, but may employ another system, for example, in which the keeping bill storage section additionally has a discharging function.

As described above, an inventive bill handling machine receives multiple kinds of bills from the exterior to store them temporarily and discharge a specified bill from the stored bills to the exterior. The bill handling machine includes: a machine body for conveying a bill received from the exterior and storing bills other than a dischargeable bill; and one or more detachable boxes having a mounted section detachably mounted to a mount section of the machine body for storing and discharging a dischargeable bill which is conveyed from the machine body. The machine body includes a distinguishing device for distinguishing whether or not a bill received from the exterior is a dischargeable bill, a conveying device for conveying a bill in the normal or reverse direction between the distinguishing device and the mounting section, and a keeping bill storage section for storing bills other than the dischargeable bill which is conveyed by the conveying device. The detachable box includes a dischargeable bill storage section for storing at least the dischargeable bill which is conveyed by the conveying device so as to be discharged.

In the bill handling machine, the distinguishing device distinguishes whether or not a bill received from the exterior is a dischargeable bill and the conveying device conveys bills other than the dischargeable bill to the keeping bill storage section, while it conveys the dischargeable bill in the normal direction to the mounting section. When the mounting section is mounted to the mounted section, the detachable box temporarily stores the dischargeable bill which has reached the mounting section through the conveying device into the dischargeable bill storage section. When the bill is discharged from the dischargeable bill storage section, the conveying device conveys the bill in the reverse direction to the exterior. When the dischargeable bill storage section for storing and discharging the dischargeable bill has been filled with bills or into a state close to that, the detachable box is detached from the machine body. Bills in the detached detachable box is quickly drawn out using a bill collecting device separately prepared, and the detachable box is mounted to the machine body again. Alternatively, if multiple detachable boxes are provided, another detachable box with the same structure in which a specified number of bills is stored is mounted in place of that, and bills in the detached detachable box are drawn out quickly by using the bill collecting device. Accordingly, even if the bills in the detached detachable box are bent or curled bills which may cause bill jamming, the occurrence of bill jamming in the bill handling machine can be prevented since bills are collected outside the bill handling machine. This eliminates the necessity of recovery because of the occurrence of bill jamming, allowing quick bill-handling operation. The bill collecting device may have a structure in which the dischargeable bill storage section of the detachable box is operated in reverse to that of the bill-storing operation. In order to allow quick operation, it is preferable to use one with high-speed reverse operation.

In the inventive bill handling machine, the machine body includes an active torque transmission unit constituting a part of the conveying device at the mounting section and the detachable box comprises a passive torque transmission unit at the mounted section which is brought into engagement with the active torque transmission unit to drive the dischargeable bill storage section. The active torque transmission unit and the passive torque transmission unit are brought into engagement with each other by mounting the detachable box to the machine body and brought out of engagement by dismounting.

With this structure, even when another detachable box is attached to the machine body in place of the full detachable box, as described above, the dischargeable bill storage section in the replaced detachable box can be operated through the active torque transmission unit and the passive torque transmission unit.

In the inventive bill handling machine, the mounting section of the machine body has a connector, while the detachable box has an opposing connector electrically connected to the connector by being mounted to the machine body. At least one of electricity and a signal is supplied from the machine body to the detachable box by electrical connection of the connectors.

With this structure, also when another empty detachable box is mounted to the machine body in place of the full detachable box, as described above, electricity and control signals can be supplied from the machine body to the replaced detachable box through the electrically connected connectors. As a matter of course, the signals from the detachable box to the machine body, for example, the detection signals of the sensors provided in the detachable box can also be supplied by the connection of the connectors. Providing each detachable box with means for driving the dischargeable bill storage section allows the dischargeable bill storage section of the detachable box to be operated by supplying electricity and signals from the machine body to the detachable box by the connection of the connectors.

In the inventive bill handling machine, at least one of the active torque transmission unit and the passive torque transmission unit includes a clutch. The transmission of the driving force to the dischargeable bill storage section is breakable off with the passive torque transmission unit being in the engagement with the active torque transmission unit.

With this structure, when the bill received from the exterior is a specified bill, after the bill is stored in the dischargeable bill storage section of the detachable box and then the clutch is brought out of engagement, so that the storing operation of the detachable box and the bill-convey and storing operation of the machine body can be separated.

In the inventive bill handling machine, the engagement and disengagement of the clutch are performed according to an inlet sensor provided in the vicinity of the slot of a convey passage for conveying a bill in the machine body, an outlet sensor provided in the vicinity of the outlet of the convey passage, and a passage sensor provided in the vicinity of the inlet of the convey passage in the detachable box. At the bill-storing operation of the dischargeable bill storage section, when the trailing end of the bill passes through the passage sensor, the clutch is brought out of engagement and, when the leading end of the following bill to be stored passes through the outlet sensor, the clutch is brought into engagement.

With this structure, at the bill-storing operation of the dischargeable bill storage section, when the trailing end of the bill passes through the passage sensor, the clutch is brought out of engagement and, when the leading end of the following bill to be stored passes through the outlet sensor, the clutch is brought into engagement. Accordingly, the separation distance between the trailing end of the bill that is stored in the dischargeable bill storage section immediately before and the leading end of the following bill can be provided at a specified interval corresponding to the separation distance between the passage sensor and the outlet sensor, thereby improving the efficiency in storage while preventing the overlap of the preceding and following bills.

In the inventive bill handling machine, the engagement and disengagement of the clutch are performed according to an inlet sensor provided in the vicinity of the slot of a convey passage for conveying a bill in the machine body, an outlet sensor provided in the vicinity of the outlet of the convey passage, and the number of bills to be discharged which is calculated by the machine body. At the time of discharging a bill from the dischargeable bill storage section, when the trailing end of the bill passes through the outlet sensor, the clutch is brought out of engagement; when the trailing end of the bill passes through the inlet sensor, the clutch is brought into engagement; and the disengagement and engagement of the clutch are performed by the number of times corresponding to the number of bills to be discharged.

With this structure, at the time of discharging a bill from the dischargeable bill storage section, when the trailing end of the bill passes through the outlet sensor, the clutch is brought out of engagement; when the trailing end of the bill passes through the inlet sensor, the clutch is brought into engagement. Accordingly, when the trailing end of the bill passes through the outlet sensor, the following bill is brought into standby mode in the detachable box, in which state the preceding bill is discharged to the slot of the machine body. When the trailing end of the preceding bill has passed through the inlet sensor, i.e., it has been drawn out, the clutch is brought into engagement to allow the following dischargeable bill similarly. Since the number of engagement and disengagement of the clutch corresponds to the number of bills to be discharged, excess payment of bills can be prevented.

The distinguishing device distinguishes whether or not a bill received from the exterior is a dischargeable bill and the conveying device conveys bills other than the dischargeable bill to the keeping bill storage section, while it conveys the dischargeable bill to the mounting section in the normal direction. When the mounting section is mounted to the mounted section, the detachable box temporarily stores the dischargeable bill which has reached the mounting section through the conveying device into the dischargeable bill storage section. When the bill is discharged from the dischargeable bill storage section, the conveying device conveys the bill in the reverse direction to the exterior. When the dischargeable bill storage section for storing and discharging the dischargeable bill has been filled with the bills or into a state close to that, the detachable box is detached from the machine body. The bills in the detached detachable box are quickly drawn out using a bill collecting device separately prepared, and the detachable box is mounted to the machine body again or, alternatively, if multiple detachable boxes are provided, another detachable box with the same structure in which a specified number of bills is stored is mounted in place of that, and the bills in the detached detachable box are drawn out quickly by using the bill collecting device. Accordingly, even if the bills in the detached detachable box are bent or curled bills which may cause bill jamming, the occurrence of bill jamming in the bill handling machine can be prevented since the bills are collected outside the bill handling machine. This eliminates the necessity of recovery because of the occurrence of bill jamming, allowing quick bill-handling operation.

The invention claimed is:

1. A bill handling machine for receiving multiple kinds of bills from the exterior to store them temporarily and discharging a specified bill from the stored bills to the exterior, comprising:

a machine body for conveying a bill received from the exterior and storing bills other than a dischargeable bill, and at least one detachable box having a mounted section detachably mounted to a mounting section of the machine body for storing and discharging a dischargeable bill which is conveyed from the machine body, wherein the machine body includes a distinguishing device for distinguishing whether or not a bill received from the exterior is a dischargeable bill, a conveying device for conveying the bill in a normal or reverse direction between the distinguishing device and the mounting section, a keeping bill storage section for storing bills other than the dischargeable bill which is conveyed by the conveying device, and an active torque transmission unit constituting a part of the conveying device at the mounting section; and the detachable box includes a dischargeable bill storage section for storing at least the dischargeable bill which is conveyed by the conveying device so as to be discharged, a passive torque transmission unit at the mounted section of the detachable box and being engageable with the active torque transmission unit to drive the dischargeable bill storage section, the active torque transmission unit and the passive torque transmission unit being engageable with each other by mounting the detachable box to the machine body and being disengageable by dismounting the detachable box from the machine body, at least one of the active torque transmission unit and the passive torque transmission unit comprising a clutch, and wherein transmission of a driving force to the dischargeable bill storage section is capable of being shut off in a state where the passive torque transmission unit is in engagement with the active torque transmission unit, the clutch being brought out of engagement when a bill received from the exterior is other than a dischargeable bill, the engagement and disengagement of the clutch being performed according to an inlet sensor provided in the vicinity of a slot of a convey passage for conveying a bill in the machine body, an outlet sensor provided in the vicinity of an outlet of the convey passage, and a passage sensor provided in the vicinity of the inlet of a convey passage in the detachable box, wherein at the bill-storing operation of the dischargeable bill storage section, when the trailing end of a bill passes through the passage sensor the clutch is brought out of engagement and when the leading end of the following bill to be stored passes through the outlet sensor the clutch is brought into engagement.

2. A bill handling machine according to claim 1, wherein the mounting section of the machine body has a connector, while the detachable box has an opposing connector electrically connected to the connector by being mounted to the machine body, wherein at least one of electricity and a signal is supplied from the machine body to the detachable box by electrical connection of the connectors.

3. A bill handling machine for receiving multiple kinds of bills from the exterior to store them temporarily and discharging a specified bill from the stored bills to the exterior, comprising:

a machine body for conveying a bill received from the exterior and storing bills other than a dischargeable bill, and at least one detachable box having a mounted section detachably mounted to a mounting section of the machine body for storing and discharging a dischargeable bill which is conveyed from the machine body, wherein the machine body includes a distinguishing device for distinguishing whether or not a bill received from the exterior is a dischargeable bill, a conveying device for conveying the bill in a normal or reverse direction between the distinguishing device and the mounting section, a keeping bill storage section for storing bills other than the dischargeable bill which is conveyed by the conveying device, and an active torque transmission unit constituting a part of the conveying device at the mounting section; and the detachable box includes a dischargeable bill storage section for storing at least the dischargeable bill which is conveyed by the conveying device so as to be discharged, a passive torque transmission unit at the mounted section of the detachable box and being engageable with the active torque transmission unit to drive the dischargeable bill storage section, the active torque transmission unit and the passive torque transmission unit being engageable with each other by mounting the detachable box to the machine body and being disengageable by dismounting the detachable box from the machine body, at least one of the active torque transmission unit and the passive torque transmission unit comprising a clutch, and wherein transmission of a driving force to the dischargeable bill storage section is capable of being shut off in a state where the passive torque transmission unit is in engagement with the active torque transmission unit, the clutch being brought out of engagement when a bill received from the exterior is other than a dischargeable bill, the engagement and disengagement of the clutch being performed according to an inlet sensor provided in the vicinity of the slot of a convey passage for conveying a bill in the machine body, an outlet sensor provided in the vicinity of the outlet of the convey passage, and the number of bills to be discharged which is calculated by the machine body, wherein, at the time of discharging a bill from the dischargeable bill storage section, when the trailing end of a bill passes through the outlet sensor, the clutch is brought out of engagement; when the trailing end of a bill passes through the inlet sensor, the clutch is brought into engagement; and the disengagement and engagement of the clutch are performed by the number of times corresponding to the number of bills to be discharged.

* * * * *